US006632106B2

(12) United States Patent
Musolf et al.

(10) Patent No.: US 6,632,106 B2
(45) Date of Patent: Oct. 14, 2003

(54) JACK; JACK ASSEMBLY; AND METHODS

(75) Inventors: Bruce Musolf, Eagan, MN (US); Doug Elliot, Waconia, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

(21) Appl. No.: 09/911,848

(22) Filed: Jul. 24, 2001

(65) Prior Publication Data

US 2003/0022559 A1 Jan. 30, 2003

(51) Int. Cl.[7] ..... H01R 24/04

(52) U.S. Cl. ..... 439/668

(58) Field of Search ..... 429/49; 439/354, 439/540.1, 528, 620, 668, 669

(56) References Cited

U.S. PATENT DOCUMENTS

| | | | |
|---|---|---|---|
| 3,109,997 | A | 11/1963 | Giger et al. |
| 3,360,747 | A | 12/1967 | Lancaster |

(List continued on next page.)

FOREIGN PATENT DOCUMENTS

| | | |
|---|---|---|
| EP | 0 243 296 | 10/1987 |
| EP | 0 364 658 | 4/1990 |
| EP | 0 380 210 | 8/1990 |
| GB | 1549201 | 8/1979 |
| GB | 2115237 | 9/1983 |
| GB | 2133938 | 8/1984 |
| WO | WO 96/38884 | 12/1996 |

OTHER PUBLICATIONS

Switchcraft® Brochure, "SNAP–56, Switchcraft New Advanced Plug–In", pp. 1–4, 1987.

Augat® Telzon®, "Now It Is", pp. 1–2.

Telect®, "Quality and Designs, Our New DSX 3/4 Module", Spokane Industrial Park, Building 12, Spokane, Washington 99216, pp. 1–2.

AT&T Network Systems, "Technical Description, Western Electric® Products, 800–Series DSX Frame System", pp. 1–2, Jan. 1986, Issue I.

ADC Communications brochure, "Digital Siganal Cross–Connect (DSX–3) Front and Rear Cross–Connect Products", 2/99, 77 pages.

ADC Communications brochure, "Mini DSX–3 Products", 6/97, 38 pages.

ADC Telecommunications brochure, "DSX–1 Digital Signal Cross–Connect Modules, Panels, and Accessories", Sixth Edition, 85 pages, May 1998.

ADC Telecommunications brochure, "PxPlus™ DS1 Digital Signal Cross–Connect", 1/97, 12 pages.

ADC Telecommunications brochure, "84 Termination Modular Bantam Jack Panel", 9/98, 2 pages.

ADC Telecommunications brochure, "112 Termination Bantam Jack Panel", 5/99, 2 pages.

*Primary Examiner*—Tho D. Ta
*Assistant Examiner*—James Harvey
(74) *Attorney, Agent, or Firm*—Merchant & Gould, P.C.

(57) ABSTRACT

A jack includes a body having a plurality of electrically conductive spring contacts and a first and second plurality of connection locations, and a plurality of conductive pins secured to the body and projecting from walls of the body. A circuit board is secured to the body and provides circuit paths to make electrical contact between the spring contacts and the connection locations. The jack is usable in a chassis to form a jack and chassis assembly, wherein the chassis has an open front face and an open back face. The open back face permits accessibility to the projecting pins of the jack, such that it may be wire connected. Secured to the chassis is a circuit board having a plurality of sockets. The sockets provide power and ground connections to each jack. Methods of assembling and providing DSX connections include structures as described herein.

22 Claims, 8 Drawing Sheets

U.S. PATENT DOCUMENTS 3,529,264 A 9/1970 Lancaster
3,740,699 A 6/1973 Johnson et al.
3,852,703 A 12/1974 Carney et al.
4,017,770 A 4/1977 Valfre
4,087,151 A 5/1978 Robert et al.
4,087,648 A 5/1978 Giacoppo
4,106,841 A 8/1978 Vladic
4,154,994 A 5/1979 Seiden et al.
4,237,352 A 12/1980 Seiden
4,286,121 A 8/1981 Olszewski et al.
4,439,809 A 3/1984 Weight et al.
4,470,100 A 9/1984 Rebaudo et al.
4,510,552 A 4/1985 Kanno et al.
4,514,030 A 4/1985 Triner et al.
4,536,052 A 8/1985 Baker et al.
4,588,251 A 5/1986 Newton
4,605,275 A 8/1986 Pavel
4,618,194 A 10/1986 Kwilos
4,650,933 A 3/1987 Benda et al.
4,737,113 A 4/1988 Hopper et al.
4,749,968 A 6/1988 Burroughs
4,768,961 A 9/1988 Lau
4,770,639 A 9/1988 Lau
4,797,114 A 1/1989 Lau
4,815,104 A 3/1989 Williams et al.
4,820,200 A 4/1989 Lau
4,840,568 A 6/1989 Burroughs et al.
4,867,690 A * 9/1989 Thumma ..... 439/79
4,941,165 A 7/1990 Rademacher et al.
5,199,878 A 4/1993 Dewey et al.
5,246,378 A 9/1993 Seiceanu
5,393,249 A 2/1995 Morgenstern et al.
5,432,847 A 7/1995 Hill et al.
5,439,395 A 8/1995 Laukzemis
5,467,062 A 11/1995 Burroughs
5,546,282 A 8/1996 Hill et al.
5,552,962 A 9/1996 Feustel et al.
5,582,525 A 12/1996 Louwagie et al.
5,634,822 A * 6/1997 Gunell ..... 439/668
5,685,741 A 11/1997 Dewey et al.
6,116,961 A 9/2000 Henneberger et al.
6,186,798 B1 * 2/2001 Follingstad et al. ..... 439/76.1

* cited by examiner

JACK; JACK ASSEMBLY; AND METHODS

TECHNICAL FIELD

This disclosure relates generally to cross-connect assemblies. In particular, this disclosure relates to jacks, jack assemblies, digital cross-connect systems, and methods utilizing these devices.

BACKGROUND OF THE INVENTION

A digital cross-connect system (DSX) provides a location for interconnecting two digital transmission paths. The apparatus for a DSX is located in one or more frames, or bays, usually in a telephone central office. The DSX apparatus also provides jack access to the transmission paths.

DSX jacks are well known and include a plurality of bores sized for receiving tip and ring plugs. A plurality of spring contacts are provided within the bores for contacting the tip and ring plugs. The jacks are typically electrically connected to digital transmission lines, and are also electrically connected to a plurality of wire termination members used to cross-connect the jacks. By inserting plugs within the bores of the jacks, signals transmitted through the jacks can be interrupted or monitored.

SUMMARY OF THE INVENTION

In one aspect, this disclosure describes a jack assembly that eliminates many parts of prior art assemblies and simplifies the DSX connection.

In one aspect, a jack is provided that includes a body having a forward wall, an opposite rear wall and an interior chamber with a plurality of bores. Each of the bores is sized to receive a plug having a tip contact and a ring contact. A plurality of electrically conductive spring contacts is oriented within the interior chamber. Each of the spring contacts includes a tip spring contact and a ring spring contact. A first plurality of connection locations is secured to the body and projects from the forward wall. A second plurality of connection locations is secured to the body and projects from the rear wall. A plurality of conductive pins is secured to the body and projects from the rear wall. A circuit board is secured to the body and includes a first and second plurality of circuit paths. The first plurality of circuit paths is disposed on the circuit board to make electrical contact between the plurality of spring contacts and the first plurality of connective locations. The second plurality of circuit paths makes electrical contact between the spring contacts and the second plurality of connective locations.

In another aspect, the disclosure is directed to a jack assembly that includes a jack, as described above, and a chassis. The chassis defines a frame, and the jack is removably mounted to the frame. A circuit board is mounted on the frame of the chassis and has a socket secured thereto and in electrical contact therewith. The socket is in receipt of and in electrical contact with the plurality of conductive pins of the jack.

In another aspect, the disclosure is directed to a method for assembling a jack assembly. The method includes providing a jack, as described above; providing a chassis, including a frame; and operably mounting the jack onto the frame through an open front face in the frame. The step of operably mounting the jack includes mounting it such that the second plurality of connective locations of the jack projects and is accessible through the open back face of the frame.

In another aspect, the disclosure is directed to a chassis for a DSX system. The chassis includes a frame having a plurality of walls that define an open, unobstructed front face and an open, unobstructed back face. Two of the walls in opposition to each other define a plurality of slots sized to receive a jack therewithin. The open, unobstructed front face is in open communication with aligned slot pairs, while the open, unobstructed back face is open communication with one of the plurality of receiving slots.

DETAILED DESCRIPTION OF THE PREFERRED EMBODIMENT

Figure 1:
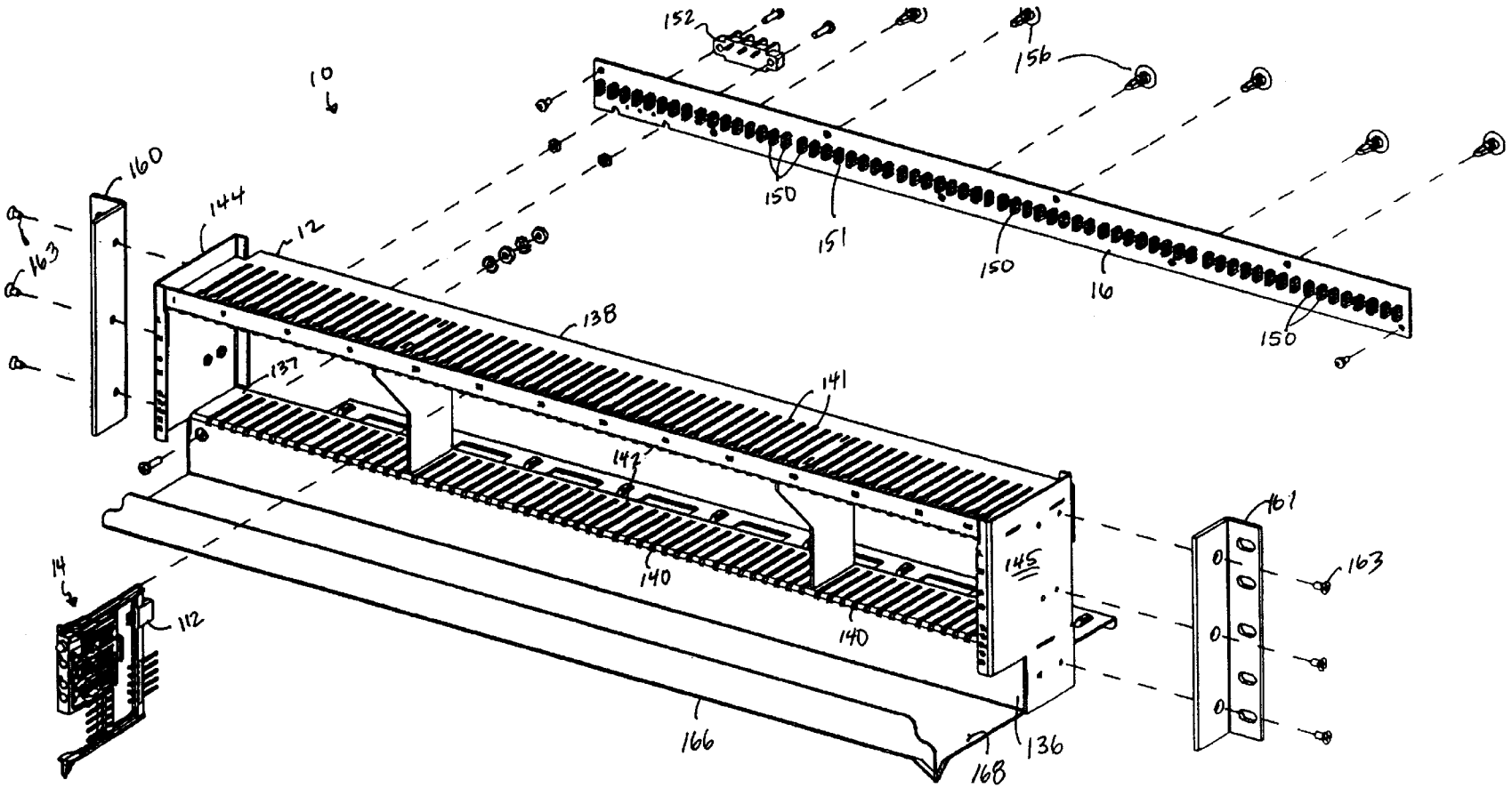
FIG. 1 is an exploded, perspective view of a jack assembly, constructed according to principles of this disclosure.

In reference to FIG. 1, a jack and chassis assembly is shown generally at 10. Jack and chassis assembly 10 includes a housing or chassis 12 and at least one, but preferably a plurality, of jacks 14. In this drawing, only a single jack 14 is depicted, for purposes of clarity. Each jack 14 is identical. Thus, a description of one will suffice as a description of all jacks. Also depicted in FIG. 1 is a printed circuit board 16, whose function is described further below.

A. Jack Body and Cover

Jack 14 includes a jack body 18, a circuit board 20, and a plurality of wire wrap termination pins and spring contacts as will be described below. In reference to FIGS. 2–6, the jack body 18 is formed of plastic or any suitable dielectric material. Preferably, jack body 18 and its elements are integrally formed by injection molding.

Jack body 18 includes parallel upper and lower rails 21, 22. Rear ends of rails 21, 22 are joined by a vertical post 24. The forward end of rail 20 is provided with a resilient cantilevered portion 26 that includes an operator engageable tab 30 to permit the jack 14 to be selectively mounted and locked within the chassis 12. The lower rail 22 has a smooth, slide surface 28, that slidably engages a slot or groove in the chassis 12, as will be further described below.

Connected to the upper rail 21 at its forward end is a spring housing portion 32 of the body 18. The housing 32 includes forward wall 34 that extends from a forward end of the upper rail 21 toward the lower rail 22. Intermediate the forward wall 34 and the vertical post 24, the spring housing portion 32 includes a rear wall 36 that also extends partly the distance from rail 20 toward rail 21. Forward wall 34 and rear wall 36 are joined by top wall 38 and bottom wall 40. At the point of intersection of rear wall 36 and bottom wall 40, the housing portion 32 is connected to the lower rail 22 by an intermediate vertical post 42. Rear wall 36, vertical post 24, intermediate post 42, and rails 20, 21 all cooperate to define area 43.

Figure 2:
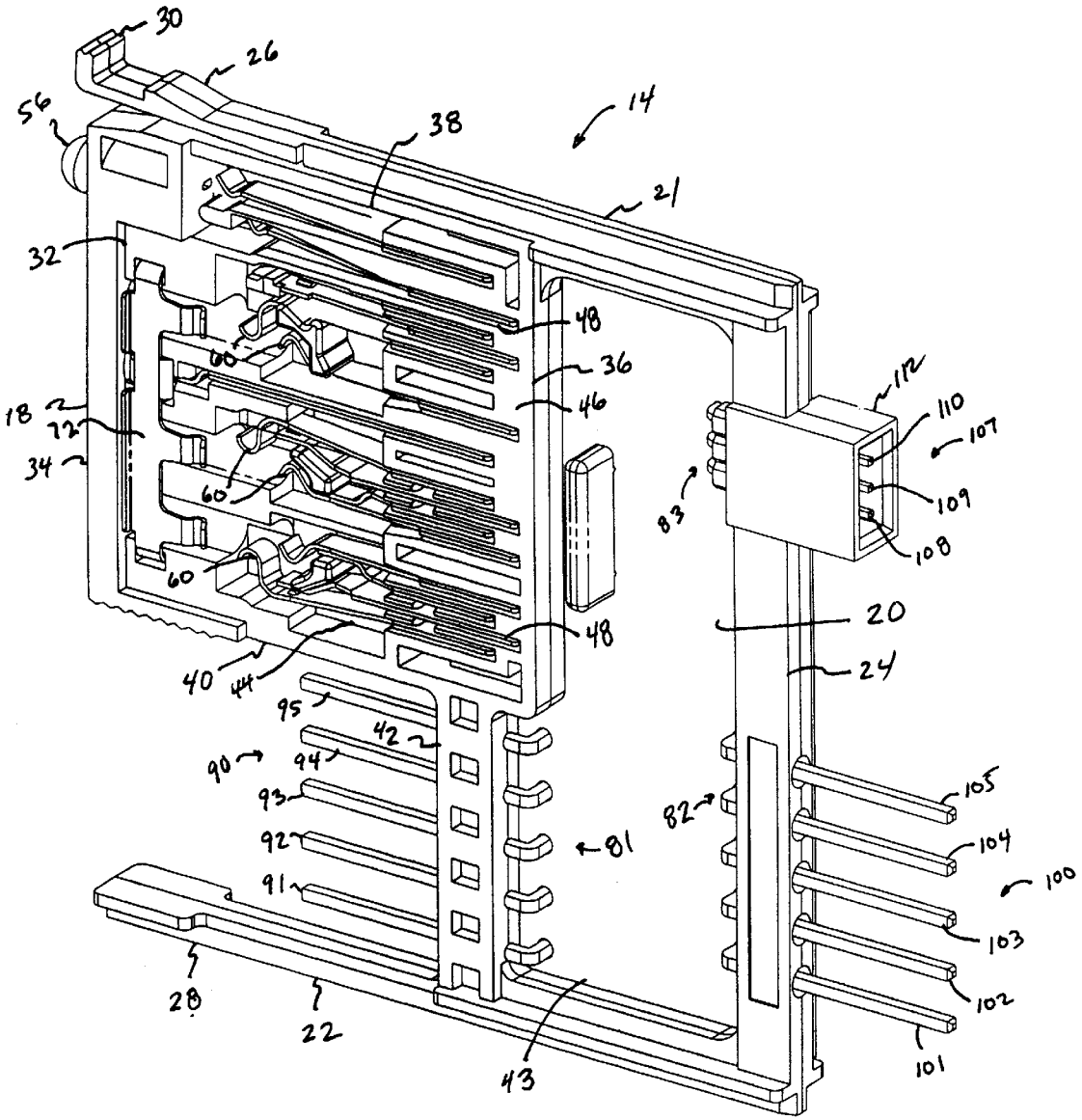
FIG. 2 is a perspective view of a jack utilized in the jack assembly depicted in FIG. 1.
Figure 5:
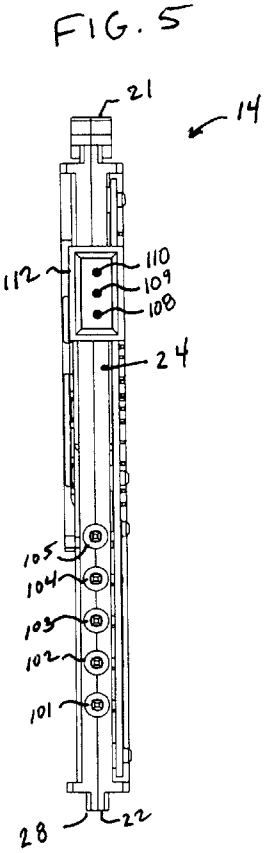
FIG. 5 is a rear end elevational view of the jack depicted in FIGS. 2–4.
Figure 4:
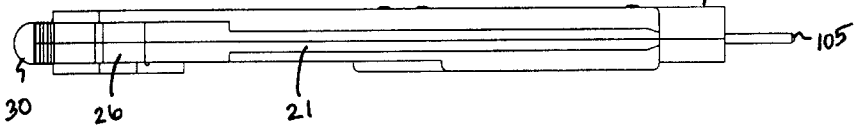
FIG. 4 is an end elevational view of the jack depicted in FIGS. 2 and 3.
Figure 6:
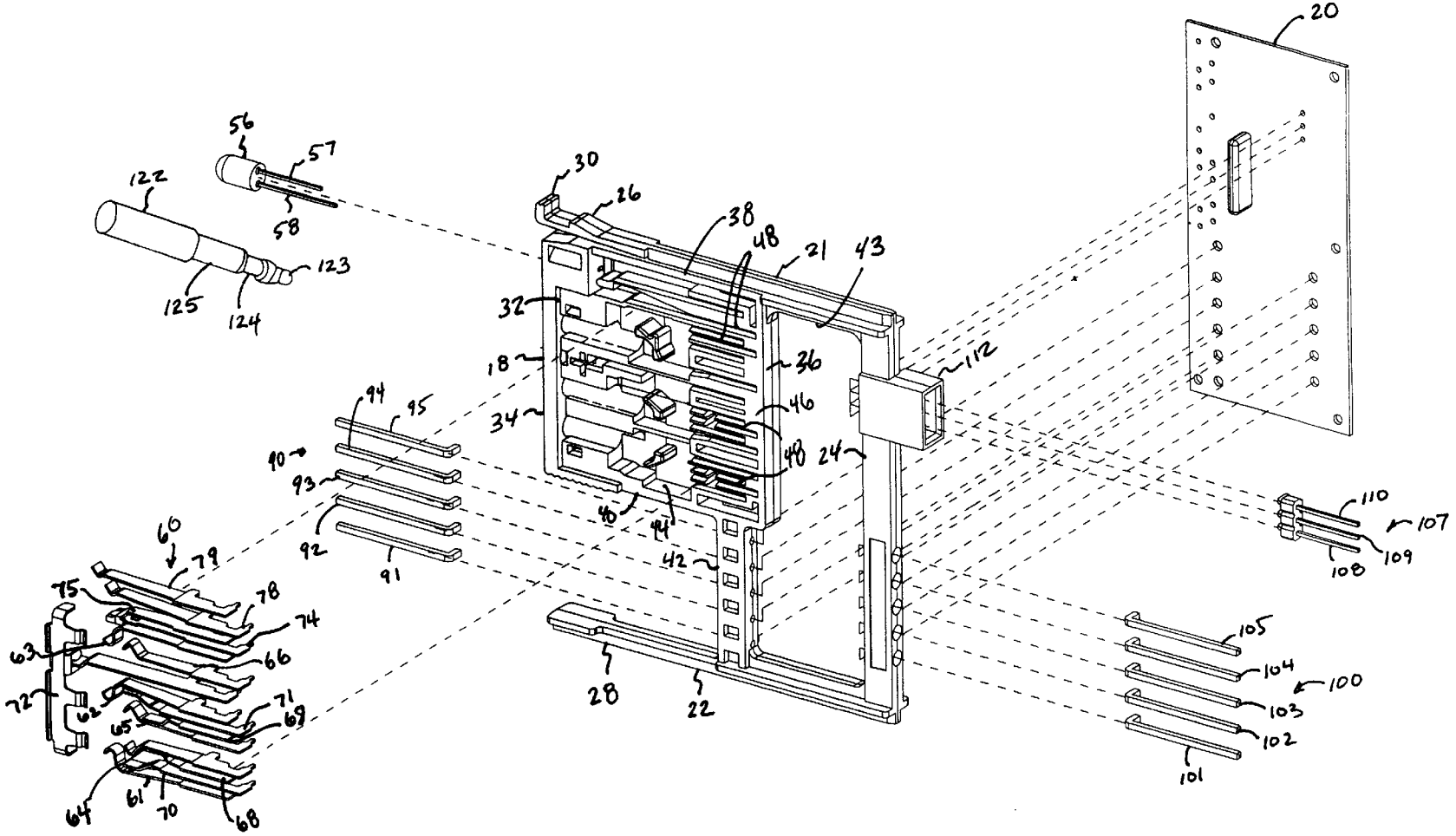
FIG. 6 is an exploded, perspective view of the jack depicted in FIGS. 2–5.

As can be seen in FIGS. 2 and 6, the spring housing portion 32 is recessed to define a chamber 44. Within the chamber 44, a plurality of raised platforms 46 are disposed along the rear wall 36.

In the preferred embodiment illustrated, the platforms 46 define a plurality of parallel aligned spaced apart spring receiving slots 48. The slots 48 are parallel to the top and bottom walls 38, 40. The slots 48 help to hold the springs, as described further below. The forward wall 34 of the spring housing portion 32 is provided with three bores 51, 52, 53 (shown with hidden lines in FIG. 3), in communication with chamber 44. For convenience, bore 51 will be referred to as IN bore 51; bore 52 will be referred to as OUT bore 52; and bore 53 will be referred to as monitor or MON bore 53. Each of the bores 51, 52, 53 is sized to receive a standard tip and ring plug 122 (FIG. 6) of known dimensions. One such plug is described in U.S. Pat. No. 4,840,568, which disclosure is incorporated herein by reference. As known in the art, the plugs 122 include a tip contact 123, a ring contact 124, and a cylindrical sleeve 125.

Figure 3:
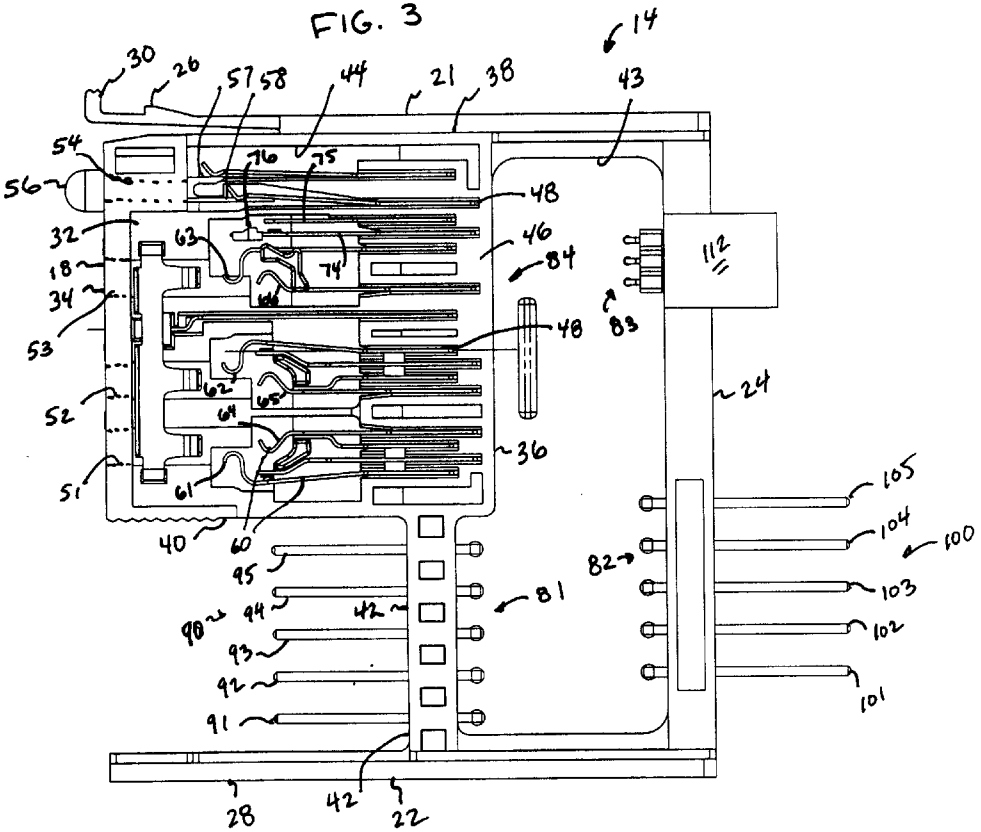
FIG. 3 is a side elevational view of the jack depicted in FIG. 2.

The forward wall 34 further includes a fourth bore 54 sized to receive a light emitting diode (LED) 56. As can be seen in FIGS. 3 and 6, the LED 56 includes a pair of electrical leads 57, 58 that extends from the light of the LED 56.

B. Spring Contacts

A plurality of spring contacts 60 are disposed within the chamber 44. The spring contacts 60 include ring spring contacts 61, 62, 63 (FIG. 6), which are disposed within the spring housing portion 32 to make electrical connection with the ring contacts 124 of the tip and ring plugs 122 inserted within the bores 51, 52, 53. Similarly, the spring contacts 60 include tip contacts 64, 65, 66 disposed within the chamber 44 to make electrical contact with the tip contacts 123 of plugs 122 that are disposed within the bores 51, 52, 53.

The spring contacts 60 also include tip normal spring contacts 68, 69 that are disposed within the chamber 44 for tip normal contact 68 to be in electrical contact with tip contact 64 when no plug 122 is inserted within the IN bore 51. Similarly, tip normal contact 69 is disposed within the chamber 44 to make electrical contact with tip ring contact 65 when no plug 122 is received within the OUT bore 52.

The plurality of spring contacts 60 further includes ring normal contacts 70, 71. Ring normal contacts 70, 71 are configured to be in electrical contact with ring contacts 61, 63 when no plugs 122 are inserted within the bores 51, 52.

The plurality of spring contacts 60 also includes contact 72, which is a grounding contact. Grounding contact 72 is constructed and arranged within the chamber 44 to engage sleeves 125 of plugs 122 that are received within the bores 51, 52, 53.

Spring contacts 60 also includes LED circuit actuating contacts 74, 75. A free end of contact 74 is provided with a sleeve 76 of dielectric material. Upon insertion of a plug within bore 53, ring contact 63 is displaced and sleeve 76 urges contact 74 against contact 75.

Spring contacts 60 further includes LED contacts 78, 79. The LED contacts 78, 79 are positioned to contact the electrical leads 57, 58 of LED 56 inserted within bore 54.

C. Circuit Board

Circuit board 20 is sized to cover the area 43 bounded by top rail 21, bottom rail 22, vertical post 24, and intermediate post 42.

Circuit board 20 is of standard construction and includes four sets of contact points 81, 82, 83 and 84. Circuitry of the board 20 includes a plurality of circuit paths, shown generally at 86 in FIG. 7, to provide electrical contact between the contact points 81–84. The contact points 84 correspond to termination points of the springs 60. The other contact points 81, 82, 83 are described below. The circuitry is also described below.

D. Connective Locations

In reference again to FIGS. 2–6, a first plurality 90 of connective locations, shown as wire termination pins, in particular, five wire wrap termination pins 91–95 project and extend from the intermediate post 42 and are aligned in a plane generally parallel to and in parallel alignment with the spring contacts 60. As can be seen in FIG. 2, the wire wrap termination pins 91–95 have 90 degree bends terminating at the first contact points 81 on the circuit board 20.

Extending from the vertical post 24 and projecting therefrom is a second plurality 100 of connective locations, shown as wire termination pins, specifically five wire wrap termination pins 101–105. Each of pins 101–105 also has 90 degree bends and terminates at the second contact points 82 of the circuit board 20.

A plurality 107 of conductive pins 108, 109, 110 extends and projects from the vertical post 24. Each of pins 108–110 has a 90 degree bend that terminates at third contact points 83.

The plurality of pins 107 is enclosed by a surrounding wall or shroud 112. As can be seen in FIGS. 2 and 6, the shroud 112 has a rectangular cross-section and is generally box shaped to enclose the pins 108–110 except for the end tips. The shroud 112 helps to protect the plurality of pins 107 and also helps to provide a positive guide to help position the jack 14 properly within the printed circuit board 16 of the chassis 12 (FIG. 1).

Thus, as can be seen, in the preferred embodiment, the jack 14 includes first, second, and third sets 90, 100, and 107, respectively, of a plurality of pins extending therefrom. The function of each of the pin sets 90, 100, 107 will be become clearer after a review of the circuitry, discussed below.

While pins are illustrated in the preferred embodiment, those skilled in the art will appreciate that instead of pins, either IDC terminations or balun terminations may be substituted for pins and accomplish the same result.

E. Circuitry

The circuitry of circuit board 20 includes the circuit paths 86 connecting various combinations of the contact points 81–84. The circuitry includes circuit elements to provide well known DSX jack functions. It should be appreciate that DSX jack circuitry is conventional and known in the art. One description can be found in U.S. Pat. No. 4,840,568, which disclosure is incorporated herein by reference.

Figure 7:
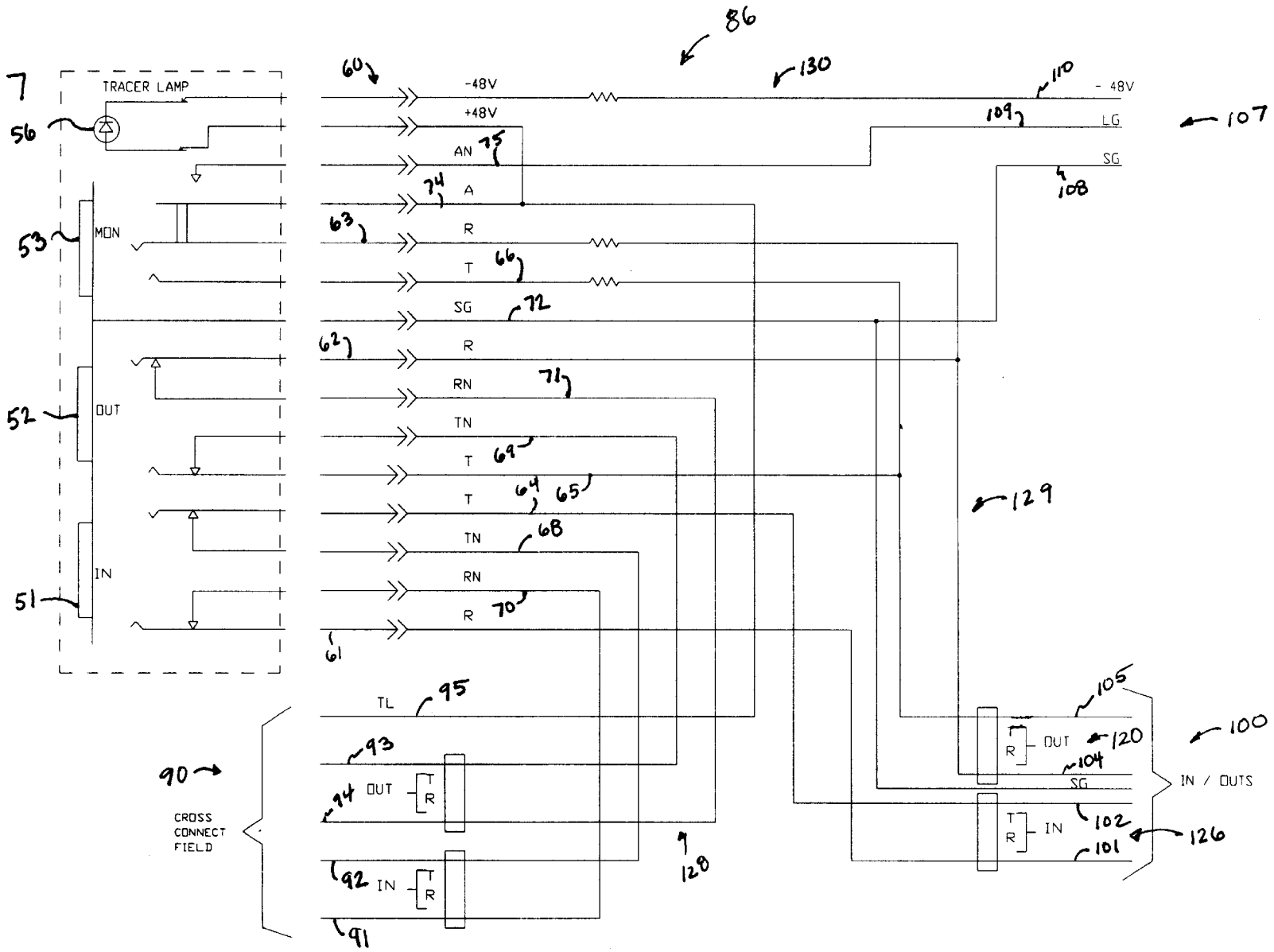
FIG. 7 is a schematic representation of the circuitry of the jack of FIGS. 2–6.

In FIG. 7, the circuitry is depicted schematically. In FIG. 7, the circuit paths 86 include a first, second, and third plurality of circuit paths 128, 129, 130. The first plurality of circuit paths 128 is disposed on the circuit board 20 to make electrical contact between the spring contacts 60 and the first plurality of connective locations 90. The second plurality of circuit paths 129 is configured to make electrical contact between the spring contacts 60 and the second plurality of connective locations 100. The third plurality of circuit paths 130 is oriented on the circuit board 20 to make electrical contact between the LED contacts 78, 79 and the plurality of conductive pins 107.

As shown in the schematic of FIG. 7, only seven of the contact points 101–105 and 108–110 are necessary for conventional DSX jack operation. The seven DSX contact points are OUT signal tip and ring contacts 104, 105; IN signal tip and ring contact 102, 101; sleeve ground contact 103 and 108; LED ground contact point 109; and an energized contact point 110 for illuminating the LED 56.

The circuitry is configured to accept an OUT signal 120 having a tip line and a ring line each connected to pin 105 and pin 104, respectively. When no plugs 122 are inserted within the bores 51, 52, 53, this signal is sent through the spring contacts 60 and to cross-connect pins 93, 94.

Cross-connection of a signal from another jack arrives as an IN signal from cross-connect wire termination pins 91, 92. With no plugs 122 inserted within the jack, the signal is output at IN signal point 126, and specifically through pins 102, 101.

By inserting plug 122 within the IN bore 51, the IN signal from cross-connected jack can be interrupted, and a signal from the inserted plug 122 can be outputted at points 102, 101. Similarly, by inserting plug 122 within the OUT bore 52, the signal from points 104, 105 is interrupted and may be outputted to the tip and ring contacts of the plug 122.

Note that the pin 108, associated with the sleeve ground, is grouped with the third set of pins 107. Upon insertion of plug 122, the sleeve 125 will be grounded through contact with the ground 72. The pin 108 is in contact with a ground connection in the circuit board 16, as will be described below.

It may be desirable to monitor signals on the OUT line without interrupting the OUT line signal. To accomplish this, plug 122 is inserted into the MON bore 53. On this occurrence, ring contact 63 is displaced and sleeve 76 acts against spring contact 74 urging it into electrical connection with contact 75. As is clear from FIG. 7, electrical connection of spring contacts 74, 75 connects the LED lamp to ground, thereby illuminating the LED.

In addition to activating the LED 56, insertion of plug 122 into the MON bore 53 also grounds the tracer lamp pin 95. This causes illumination of an LED on a jack to which the present jack is cross-connected.

F. Mount Description

Figure 8:
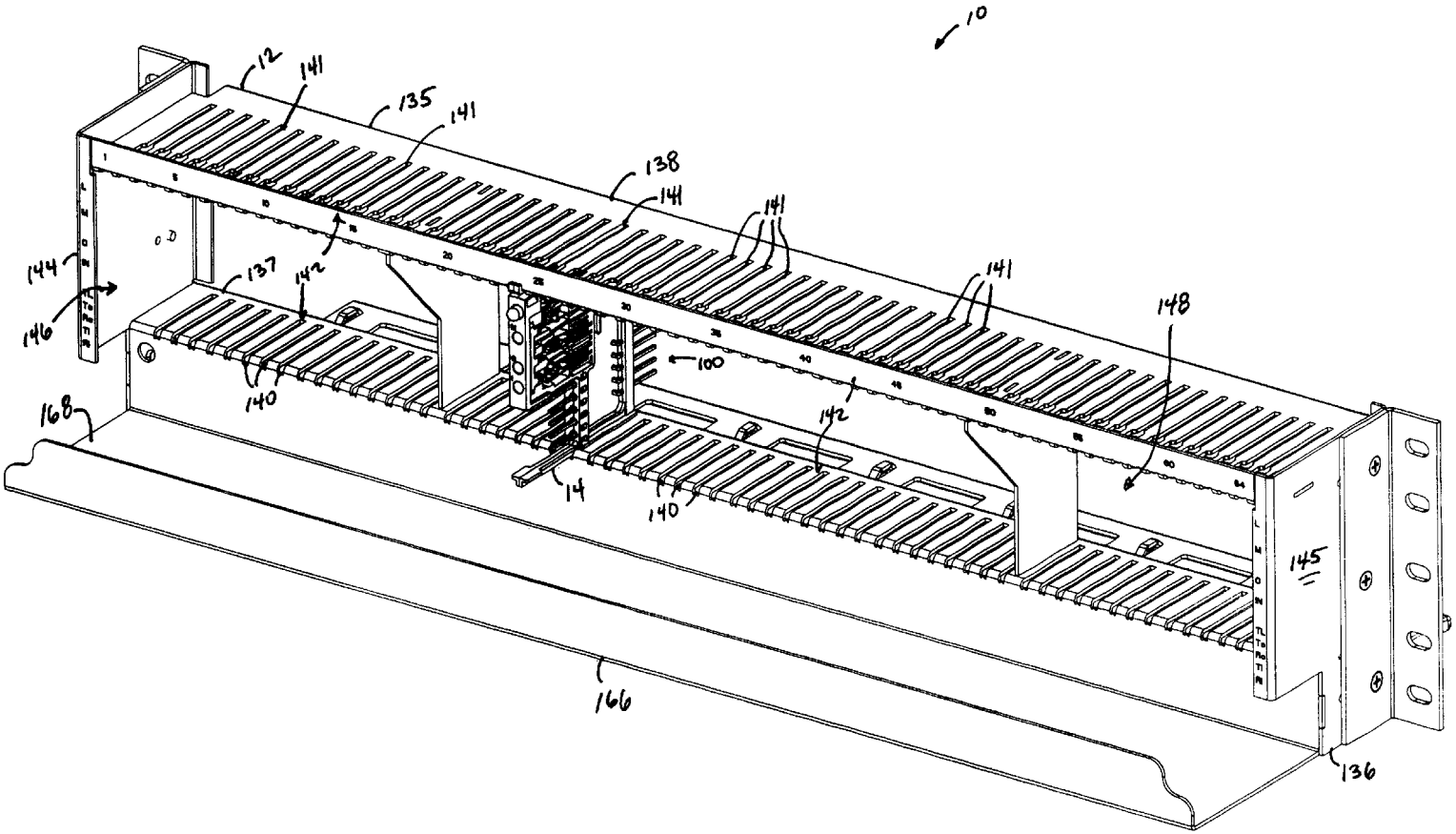
FIG. 8 is a perspective view of the jack assembly of FIG. 1 and assembled together.
Figure 9:
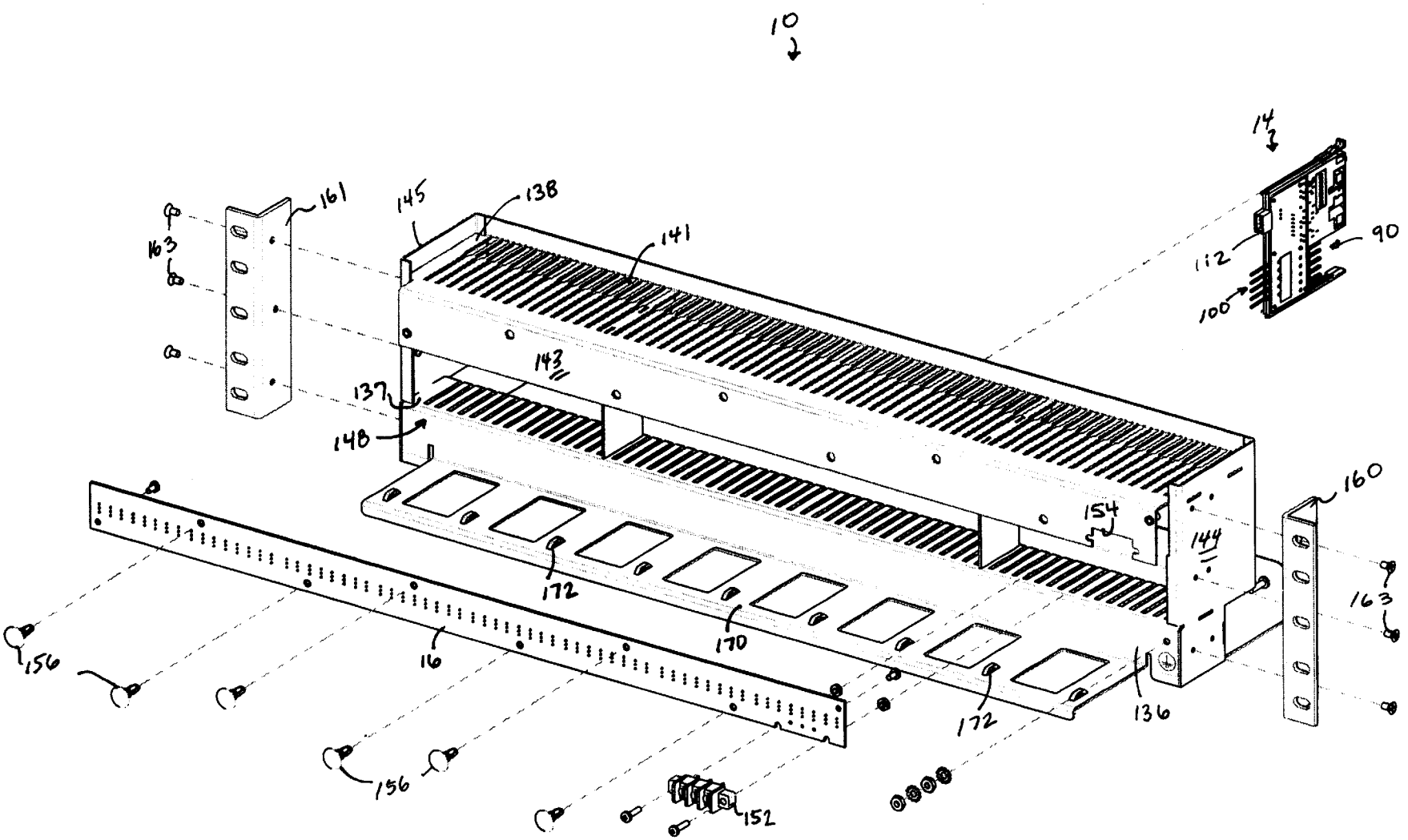
FIG. 9 is an exploded perspective view of the jack assembly shown in FIGS. 1 and 8, and view from an opposite perspective as FIG. 1.

In reference now to FIGS. 1, 8, and 9, the jack and chassis assembly 10 is shown. The chassis 12 includes a frame 135. The frame 135 includes a base 136 forming a bottom of the chassis 12. The frame 135 also includes first and second longitudinally extending walls 137, 138, parallel to each other and in opposing relation to each other. The first longitudinally extending wall 137 defines a first plurality of receiving slots 140. The second longitudinally extending wall 138 also defines a plurality of receiving slots 141 in alignment with the first plurality of slots 140. Because the slots 140, 141 are in alignment, each pair forms an aligned slot pair 142. Each of the aligned slot pairs 142 is sized to receive jack 14 therewithin. In FIG. 8, one of the jacks 14 is shown disposed within slots 140, 141.

The frame 135 also includes first and second side walls 144, 145 extending between the longitudinal walls 137, 138. Extending between the side walls 144, 145, and depending from longitudinal wall 138 is a circuit board mounting wall 143 (FIG. 9). As can be seen in FIGS. 8 and 9, the first and second side walls 144, 145 and the first and second longitudinally extending walls 137, 138 define an open, unobstructed front face 146 and an open, unobstructed back face 148. The front face 146 is in open communication with each of the aligned slot pairs 142. As such, each jack 14 can be mounted through the front face 146 by sliding the jack 14 into a pair of slots 140, 141. The back face 148 is in open communication with at least the first plurality of receiving slots 140. The second plurality of receiving slots 141 is bordered by the printed circuit board 16 and the circuit board mounting wall 43. As such, the back face 148 is defined by the edge of the circuit board mounting wall 143, the side walls 144, 145, and the longitudinal wall 137.

As can be seen in FIG. 8, the second plurality of connective locations 100 of each jack 14 extends and projects through the open back face 148. In this manner, the pins 101–105 may be directly wired by the technician through the back face 148.

Figure 10:
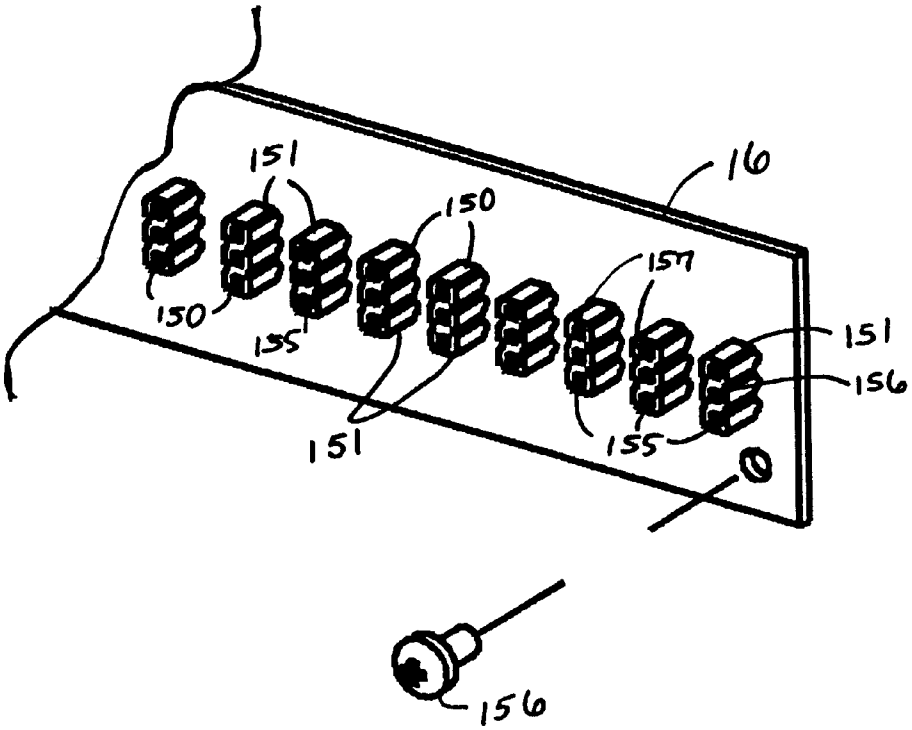
FIG. 10 is an enlarged fragmented perspective view of a circuit board with sockets depicted as part of the assembly in FIG. 1.

Secured to the frame 135 is the circuit board 16 (FIG. 1, FIG. 9, and FIG. 10). Specifically, as can be seen in FIG. 9, the circuit board 16 is mounted to the mounting wall 143, and on the opposite side of the wall 143 as shown in FIG. 9. Fasteners 156 are usable to mount the circuit board 16 to the wall 143, as are a variety of other securing structure. The circuit board 16 includes a plurality of sockets 150 (FIGS. 1 and 10) secured thereto and in electrical contact therewith. In preferred embodiments, the sockets 150 deliver power and ground contacts to the plurality of conductive pins 107. Each of the sockets 150 includes a shroud 151 (FIG. 10) sized and shaped to be received by one of the shrouds 112 protecting the third set of pins 107. This shroud-to-shroud arrangement 112, 151 also helps in aligning the jack 14 with the circuit board 16. In FIG. 10, note that each shroud 151 includes 3 sockets 155, 156, 157, one for each pin 108, 109, 110. Power and shield ground connections are provided to circuit board 16 by soldering these connections to the printed circuit board 16 at terminal block 152. The mounting wall 43 defines an access opening 154 for the terminal block 152.

Other features of the assembly 10 and viewable in FIGS. 1, 8, and 10 include first and second mounting brackets 160, 161 secured to the side walls 144, 145, respectively. The brackets 160, 161 are usable to mount the chassis 12 to framework. Fasteners 163 are usable to secure the brackets 160, 161 to the side walls 144, 145, as are a variety of other securing mechanisms. A tray 166 extends from the base 136 and defines a trough 168 therebetween. The trough 168 holds cables or wires for the cross-connect wires leading to the cross-connect pins 90. In FIG. 9, a tray 170 is shown extending from base 136. The tray 170 helps to hold and manage cables leading to the in/out pins 100. The tray 170 includes a plurality of lances 172 that are oriented to accept cable tie wrap loops to secure bundles of cables.

In the particular embodiment illustrated, the chassis 12 can accommodate at least 50, no greater than 84, and typically 64 jacks 14. In operation, to assemble the jack and chassis assembly 10, the jack is operably mounted onto the frame 135 through the open front face 146. When inserting the jack 14 into one of the aligned slot pairs 142, the lower rail 22 is slid along the slide surface 28 into one of the slots 140. The upper rail 21 is simultaneously slid through one of the upper slots 141. The tab 30 is depressed by the user to help latch the jack 14 into the chassis 12. The plurality of conductive pins 107 is inserted into one of the sockets 150. Inserting these pins 107 into the socket 150 provides power and ground connections to the jack 14. This also results in the second plurality of connective locations 100 projecting through and being accessible through the open back face 148. Next, the wires may be connected to the pins 100. In particular, a wire carrying an incoming ring signal is connected to pin 101, while an incoming tip signal is connected to pin 102. A wire to output a ring signal is connected to pin 104, and a wire to output a tip signal is connected to pin 105.

The first set of connective locations 90 may also be wire connected, typically to another jack. These connections are made on pins 91–95.

The above specification, examples and data provide a description of the invention. Many embodiments of the invention can be made.

What is claimed is:

1. A jack comprising:

(a) an integrally formed body comprising a dielectric material; said body having a forward wall; an opposite rear wall; and defining an interior chamber and a plurality of bores;

(i) said plurality of bores extending through said forward wall in communication with said interior chamber;

(A) each of said bores being sized to receive a plug having a tip contact and a ring contact;

(b) a plurality of electrically conductive spring contacts oriented within said interior chamber;

(i) each of said spring contacts including tip spring contacts and ring spring contacts;

(A) said tip spring contacts being disposed to make electrical contact with tip contacts of plugs inserted within said bores;

(B) said ring spring contacts being disposed to make electrical contact with ring contacts of plugs inserted within said bores;

(c) a first plurality of connection locations secured to said body and projecting from said forward wall;

(d) a second plurality of connection locations secured to said body and projecting from said rear wall;

(e) a plurality of conductive pins secured to said body and projecting from said rear wall;

(i) said plurality of conductive pins includes at least first and second pins;

(A) said first pin of said plurality of conductive pins constructed and arranged to be in electrical contact with a power source; and (B) said second pin of said plurality of conductive pins constructed and arranged to be in electrical contact with a ground signal for plugs, when plugs are inserted into said bores;

(f) a circuit board secured to said body; said circuit board including a first and a second plurality of circuit paths;

(i) said first plurality of circuit paths disposed on said circuit board to make electrical contact between said plurality of spring contacts and said first plurality of connection locations; and (ii) said second plurality of circuit paths disposed on said circuit board to make electrical contact between said plurality of spring contacts and said second plurality of connection locations.

2. A jack according to claim 1 wherein:

(a) said first plurality of connection locations includes at least first, second, third, and fourth wire termination pins;

(i) said first pin constructed and arranged to be in electrical contact with a ring signal from a cross-connect signal;

(ii) said second pin constructed and arranged to be in electrical contact with a tip signal from a cross-connect signal;

(iii) said third pin constructed and arranged to output a ring signal; and (iv) said fourth pin constructed and arranged to output a tip signal.

3. A jack according to claim 2 wherein:

(a) said second plurality of connection locations includes at least first, second, third, and fourth wire termination pins;

(i) said first pin of said second plurality of connection locations being constructed and arranged to be in electrical contact with an incoming ring signal;

(ii) said second pin of said second plurality of connection locations being constructed and arranged to be in electrical contact with an incoming tip signal;

(iii) said third pin of said second plurality of connection locations being constructed and arranged to be in electrical contact with an outgoing ring signal; and (iv) said fourth pin of said second plurality of connection locations being constructed and arranged to be in electrical contact with an outgoing tip signal.

4. A jack according to claim 3 further including:

(a) an LED having first and second electrical leads;

(i) said first electrical lead being in electrical contact with said first pin of said plurality of conductive pins through said circuit board; and (ii) wherein said first plurality of connection locations includes a fifth pin, and said plurality of conductive pins includes a third pin;

(A) said fifth pin being in electrical contact with said second electrical lead of said LED through said circuit board; and (B) said third pin of said plurality of conductive pins being constructed and arranged to be in electrical contact with a ground signal to provide selective grounding of circuitry for said LED.

5. A jack according to claim 4 further comprising:

(a) a shroud enclosing said plurality of conductive pins.

6. A jack according to claim 1 wherein:

(a) said body includes a flexible latch member; said flexible latch member being constructed and arranged to permit said jack to be selectively secured in a chassis.

7. A jack according to claim 1 wherein:

(a) said body includes a plurality of raised platforms disposed within said chamber, opposing surfaces of said raised platforms defining spring receiving slots;

(i) said plurality of spring contacts being oriented within said spring receiving slots.

8. A jack and chassis assembly comprising:

(a) a jack including:

(i) a body comprising a dielectric material; said body having a forward wall; an opposite rear wall; and defining an interior chamber and a plurality of bores;

(A) said plurality of bores extending through said forward wall in communication with said interior chamber;

(B) each of said bores being sized to receive a plug having a tip contact and a ring contact;

(ii) a plurality of electrically conductive spring contacts oriented within said interior chamber;

(A) each of said spring contacts including tip spring contacts and ring spring contacts;

(B) said tip spring contacts being disposed to make electrical contact with tip contacts of plugs inserted within said bores;

(C) said ring spring contacts being disposed to make electrical contact with ring contacts of plugs inserted within said bores;

(iii) a first plurality of connection locations secured to said body and projecting from said forward wall;

(iv) a second plurality of connection locations secured to said body and projecting from said rear wall;

(v) a plurality of conductive pins secured to said body and projecting from said rear wall; and (vi) a first circuit board secured to said body; said first circuit board including a first and second plurality of circuit paths;

(A) said first plurality of circuit paths disposed on said first circuit board to make electrical contact between said plurality of spring contacts and said first plurality of connection locations;

(B) said second plurality of circuit paths disposed on said first circuit board to make electrical contact between said plurality of spring contacts and said second plurality of connection locations;

(b) a chassis; said chassis defining a frame;

(i) said jack being removably mounted to said frame; and (c) a second circuit board mounted on said frame of said chassis; said second circuit board having a socket secured thereto and in electrical contact therewith;

(i) said socket being in receipt of and in electrical contact with said plurality of conductive pins.

9. An assembly according to claim 8 wherein:

(a) said frame defines an unobstructed front face and an unobstructed back face;

(i) said frame being configured to receive a jack through said front face of said frame; and (ii) said second plurality of connections locations being wire termination pins projecting through said back face of said frame.

10. An assembly according to claim 9 wherein:

(a) said frame defines a plurality of slots;

(i) each of said plurality of slots being configured to receive a jack through said front face of said frame; and (b) said second circuit board has a plurality of sockets secured thereto and in electrical contact therewith.

11. An assembly according to claim 10 further comprising:

(a) a plurality of jacks;

(i) each of said jacks being mounted in a respective one of said plurality of slots of said frame;

(ii) each of said plurality of conductive pins of each of said jacks being received by and in electrical contact with a respective socket of said plurality of sockets secured to said second circuit board; and (iii) each of said second plurality of connection locations of each of said jacks projecting and being accessible through said back face of said frame.

12. An assembly according to claim 11 wherein:

(a) each of said plurality of sockets being in electrical contact with a power signal and first and second ground signals.

13. An assembly according to claim 12 wherein:

(a) each of said jacks further includes an LED having first and second electrical leads.

14. An assembly according to claim 13 wherein:

(a) said first plurality of connection locations for each of said jacks includes first, second, third, fourth, and fifth wire termination pins;

(i) said first pin constructed and arranged to be in electrical contact with a ring signal from a cross-connect signal;

(ii) said second pin constructed and arranged to be in electrical contact with a tip signal from a cross-connect signal;

(iii) said third pin constructed and arranged to output a ring signal;

(iv) said fourth pin constructed and arranged to output a tip signal;

(v) said fifth pin being in electrical contact with said second electrical lead of said LED through said first circuit board;

(b) said plurality of conductive pins for each of said jacks includes first, second, and third pins;

(i) said first pin of said plurality of conductive pins constructed and arranged to be in electrical contact with said power signal;

(ii) said second pin of said plurality of conductive pins constructed and arranged to be in electrical contact with said first ground signal; and (iii) said third pin of said plurality of conductive pins being constructed and arranged to be in electrical contact with said second ground signal to provide selective grounding of said LED.

15. An assembly according to claim 14 wherein:

(a) said second plurality of connection locations for each of said jacks includes first, second, third, and fourth wire termination pins;

(i) said first pin of said second plurality of connection locations constructed and arranged to be in electrical contact with an incoming ring signal;

(ii) said second pin of said second plurality of connection locations constructed and arranged to be in electrical contact with an incoming tip signal;

(iii) said third pin of said second plurality of connection locations constructed and arranged to be in electrical contact with an outgoing ring signal; and (iv) said fourth pin of said second plurality of connection locations constructed and arranged to be in electrical contact with an outgoing tip signal.

16. An operable chassis for a DSX system; the chassis comprising:

(a) a frame having:

(i) a first longitudinally extending wall defining a first plurality of receiving slots;

(ii) a second longitudinally extending wall in opposition to said first longitudinally extending wall; said second longitudinally extending wall defining a second plurality of receiving slots in alignment with said first plurality of receiving slots to form a plurality of aligned slot pairs;

(A) each of said aligned slot pairs being sized to receive a jack therewithin;

(iii) a first sidewall and a second sidewall extending between said first and second longitudinally extending walls;

(A) said first sidewall, said second sidewall, said first longitudinally extending wall, and said second longitudinally extending wall defining an open, unobstructed front face and an open, unobstructed back face;

(1) said open, unobstructed front face being in open communication with each of said aligned slot pairs when the chassis is in operable use with a DSX system; and (2) said open, unobstructed back face being in open communication with said first plurality of receiving slots when the chassis is in operable use with a DSX system.

17. A chassis according to claim 16 further comprising:

(a) a circuit board depending from said second longitudinally extending wall; said circuit board having a plurality of sockets secured thereto and in electrical contact therewith;

(i) said open, unobstructed back face extending between an edge of said circuit board and said first longitudinally extending wall.

18. A chassis according to claim 17 wherein:

(a) said first and second longitudinally extending walls define at least 50 aligned slot pairs, each of the aligned slot pairs being sized to receive a jack therein.

19. A jack comprising:

(a) an integrally formed body comprising a dielectric material; said body having a forward wall; an opposite rear wall; and defining an interior chamber, a plurality of bores, and a circuit board receiving area;

(i) said plurality of bores extending through said forward wall in communication with said interior chamber;

(A) each of said bores being sized to receive a plug having a tip contact and a ring contact;

(b) a plurality of electrically conductive spring contacts oriented within said interior chamber;

(i) each of said spring contacts including tip spring contacts and ring spring contacts;

(A) said tip spring contacts being disposed to make electrical contact with tip contacts of plugs inserted within said bores;

(B) said ring spring contacts being disposed to make electrical contact with ring contacts of plugs inserted within said bores;

(c) a first plurality of connection locations secured to said body and projecting from said forward wall;

(d) a second plurality of connection locations secured to said body and projecting from said rear wall;

(e) a plurality of conductive pins secured to said body and projecting from said rear wall;

(i) said plurality of conductive pins includes at least first and second pins;

(A) said first pin of said plurality of conductive pins constructed and arranged to be in electrical contact with a power source; and (B) said second pin of said plurality of conductive pins constructed and arranged to be in electrical contact with a ground signal for plugs, when plugs are inserted into said bores;

(f) a shroud enclosing said plurality of conductive pins;

(i) said shroud being adapted to help align the jack in connection with a receiving socket, when the jack is being mounted in electrical contact with a receiving socket; and (g) a circuit board secured to said body within said circuit board receiving area; said circuit board including a first and a second plurality of circuit paths;

(i) said first plurality of circuit paths disposed on said circuit board to make electrical contact between said plurality of spring contacts and said first plurality of connection locations; and (ii) said second plurality of circuit paths disposed on said circuit board to make electrical contact between said plurality of spring contacts and said second plurality of connection locations.

20. A jack according to claim 19 wherein:

(a) each pin of said plurality of conductive pins includes a respective free end tip; and (b) said shroud encloses said plurality of conductive pins except for each said respective free end tip.

21. A jack according to claim 20 wherein:

(a) said shroud extends from said rear wall and has a rectangular cross-section.

22. A jack according to claim 21 wherein:

(a) said first plurality of connection locations includes at least first, second, third, and fourth wire termination pins extending through said forward wall of said body;

(i) said first pin constructed and arranged to be in electrical contact with a ring signal from a cross-connect signal;

(ii) said second pin constructed and arranged to be in electrical contact with a tip signal from a cross-connect signal;

(iii) said third pin constructed and arranged to output a ring signal; and (iv) said fourth pin constructed and arranged to output a tip signal; and (b) said second plurality of connection locations includes at least first, second, third, and fourth wire termination pins extending through said rear wall;

(i) said first pin of said second plurality of connection locations being constructed and arranged to be in electrical contact with an incoming ring signal;

(ii) said second pin of said second plurality of connection locations being constructed and arranged to be in electrical contact with an incoming tip signal;

(iii) said third pin of said second plurality of connection locations being constructed and arranged to be in electrical contact with an outgoing ring signal; and (iv) said fourth pin of said second plurality of connection locations being constructed and arranged to be in electrical contact with an outgoing tip signal; and (c) said body includes a flexible latch member; said flexible latch member being constructed and arranged to permit said jack to be selectively secured in a chassis.

* * * * *